US010119316B2

(12) United States Patent
Westgarth et al.

(10) Patent No.: US 10,119,316 B2
(45) Date of Patent: Nov. 6, 2018

(54) SLIDING DOOR BRAKE ASSEMBLY

(71) Applicant: FORD GLOBAL TECHNOLOGIES, LLC, Dearborn, MI (US)

(72) Inventors: Brian Westgarth, Billericay (GB); Stuart Gordon, South Benfleet (GB); Gerard Vincent Ball, Chelmsford (GB); Stephen Edward Braybrook, Billericay (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/340,667

(22) Filed: Nov. 1, 2016

(65) Prior Publication Data

US 2017/0130504 A1 May 11, 2017

(30) Foreign Application Priority Data

Nov. 9, 2015 (GB) ..... 1519696.7

(51) Int. Cl.
*E05F 5/00* (2017.01)
*E05D 15/06* (2006.01)
(Continued)

(52) U.S. Cl.
CPC ..... *E05F 5/003* (2013.01); *E05D 13/04* (2013.01); *E05D 15/0608* (2013.01);
(Continued)

(58) Field of Classification Search
CPC ..... E05F 5/003; E05D 15/0608; E05D 13/04; B66B 5/044; B66B 5/046; B66B 5/20
See application file for complete search history.

(56) References Cited

U.S. PATENT DOCUMENTS 5,864,986 A * 2/1999 Schnarr ..... E05D 13/04 49/138
6,092,630 A * 7/2000 Wendel ..... B66B 5/18 187/373

(Continued)

FOREIGN PATENT DOCUMENTS

FR 2937996 A1 5/2010
GB 2387409 A 10/2003

OTHER PUBLICATIONS

Machine translation of FR 2937996 (Mesne), retrieved from https://worldwide.espacenet.com/publicationDetails/biblio?CC=FR&NR=2937996A1&KC=A1&FT=D&ND=3&date=20100507&DB=&locale=en_EP.*

(Continued)

*Primary Examiner* — Katherine W Mitchell
*Assistant Examiner* — Abe Massad
(74) *Attorney, Agent, or Firm* — Vichit Chea; Brooks Kushman, P.C.

(57) ABSTRACT

A vehicle sliding door brake assembly configured for attachment to a sliding door mechanism of a vehicle may include a brake member connectable to the sliding door mechanism and configured to rotate about a pivot point, the brake member comprising one or more brake portions for selectively engaging a track of the vehicle so as to provide a braking force. The brake portions may be configured to form an inertial counterweight that urges the brake member to move from a neutral position in which the brake portions are not engaged with the track to an engaged position in which one or more of the brake portions are engaged with the track when a sliding door of the vehicle is subjected to an acceleration exceeding a threshold.

20 Claims, 4 Drawing Sheets

(51) Int. Cl.
*E05C 17/60* (2006.01)
*E05D 15/10* (2006.01)

(52) U.S. Cl.
CPC .. *E05D 15/1047* (2013.01); *E05D 2015/1026* (2013.01); *E05D 2015/1055* (2013.01); *E05Y 2900/531* (2013.01)

(56) References Cited

U.S. PATENT DOCUMENTS

| | | | | |
|---|---|---|---|---|
| 6,618,997 | B2 * | 9/2003 | Yokomori | E05F 15/646 477/203 |
| 6,659,230 | B1 * | 12/2003 | Jenkins | B66B 5/20 187/202 |
| 7,185,398 | B2 * | 3/2007 | Kral | E05F 1/1066 16/49 |
| 7,299,898 | B2 * | 11/2007 | Husmann | B66B 5/20 187/365 |
| 8,342,294 | B2 * | 1/2013 | Madoz Michaus | B66B 5/044 187/359 |
| 2001/0037613 | A1 * | 11/2001 | Owens | E04B 2/827 52/71 |
| 2003/0213661 | A1 * | 11/2003 | VerSteeg | E05D 13/003 188/271 |
| 2006/0137252 | A1 * | 6/2006 | Kriese | E05F 5/003 49/360 |
| 2013/0081907 | A1 * | 4/2013 | Meierhans | B66B 5/20 187/359 |

OTHER PUBLICATIONS

Combined Search and Examination Report for related application GB1519696.7, dated May 31, 2016, 6 pages.

* cited by examiner

SLIDING DOOR BRAKE ASSEMBLY

CROSS-REFERENCE TO RELATED APPLICATIONS

This application claims foreign priority benefits under 35 U.S.C. § 119(a)-(d) to GB 1519696.7 filed Nov. 9, 2015, which is hereby incorporated by reference in its entirety.

TECHNICAL FIELD

The present disclosure relates to a vehicle sliding door brake assembly.

BACKGROUND

Sliding doors are often included in motor vehicles to permit entry to the vehicle. Such sliding doors are typically manually operated. However, the opening and closing forces may be sufficiently large to damage the tracks, rollers, bump-stops, and even the body side surfaces and trim panels. Such damage can be costly and time consuming to repair. Also a damaged closure system can render the vehicle vulnerable to theft.

SUMMARY

According to an aspect of the present disclosure, there is provided a vehicle sliding door brake assembly configured for attachment to a sliding door mechanism of a vehicle, the vehicle sliding door brake assembly may include a brake member connectable to the sliding door mechanism and configured to rotate about a pivot point, the brake member comprising one or more brake portions for selectively engaging a track of the vehicle so as to provide a braking force.

The brake portions may be configured such that when the brake member is installed, the brake portions are provided between the pivot point and the track of the vehicle and that the brake portions form an inertial counterweight that urges the brake member to move from a neutral position in which the brake portions are not engaged with the track to an engaged position in which one or more of the brake portions are engaged with the track when a sliding door of the vehicle is subjected to an acceleration exceeding a threshold.

The present disclosure advantageously combines the brake portions that engage the track and the inertial counterweight. This may reduce the number of parts and the complexity.

The vehicle sliding door brake assembly may further include a resilient element configured to return the brake member to the neutral position. The brake member may comprise a cam surface and the resilient element may comprise a follower that interacts with the cam surface. The follower may be resiliently biased to return the brake member to the neutral position. The resilient element may comprise one or more resiliently biased arms that may act against one or more respective side walls of the brake member. The side walls may be arranged such that the resiliently biased arms may be moved by rotation of the brake member away from the neutral position and that the resiliently biased arms may urge the brake member to return to the neutral position.

The pivot point may be arranged such that the brake member rotates about a substantially vertical axis. The brake member may lie in a substantially horizontal plane.

The sliding door mechanism may comprise one or more wheels or rollers for engaging the track provided on the vehicle. The brake member may be configured to be positioned such that a portion of the track may be provided between the brake member and one or more of the wheels. The track may comprise a slot for receiving the wheels or rollers. The brake member may be provided outside the slot. The track may comprise an overhanging wall that overhangs a side wall of the slot. The brake member may engage the overhanging wall, e.g. on a side that faces away from the side of the slot.

The brake member may be symmetrical about an axis perpendicular to the track. The brake member may comprise first and second brake portions. The first and second brake portions may be disposed either side of an axis perpendicular to the track and passing through the pivot point. The first brake portion may engage the track when the sliding door of the vehicle is subjected to an acceleration exceeding a first threshold in a first direction. The second brake portion may engage the track when the sliding door of the vehicle is subjected to an acceleration exceeding a second threshold in a second direction opposite the first direction. The first and second thresholds may be equal or they may be different. For example, a larger acceleration may be tolerated in one direction (e.g. when closing the door) than in the other direction (e.g. when opening the door). Different thresholds may be provided by the resilient element applying different restoring forces in each direction.

The brake portions may be disposed between the pivot point and the track of the vehicle in the neutral position. In the case of there being first and second brake portions, both brake portions may remain disposed between the pivot point and the track of the vehicle in the neutral and engaged positions when one of the brake portions is engaged with the track.

The first and second brake portions may be continuous with one another, e.g. forming a continuous braking surface. The brake portions may be unitary with the remainder of the brake member.

The brake portions may extend from a central portion of the brake member. The central portion may comprise the pivot point. The brake portions may extend from the central portion at a point between the pivot point and the track. The brake portions may be unitary with the central portion.

The brake portions may comprise brake surfaces configured to selectively engage the track. The brake surfaces may be substantially parallel to the track when the brake member is in the neutral position. Alternatively, the brake surfaces may be curved. The brake surfaces of the first and second brake portions may be aligned.

A sliding door mechanism for a vehicle may comprise the above-mentioned vehicle sliding door brake assembly. A vehicle may comprise the above-mentioned the vehicle sliding door brake assembly or sliding door mechanism.

According to a further aspect of the present disclosure there is provided a method of installing, e.g. retrofitting, the above-mentioned sliding door brake assembly to a vehicle.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment.

BRIEF DESCRIPTION OF THE DRAWINGS

For a better understanding and to show more clearly how it may be carried into effect, reference will now be made, by way of example, to the accompanying drawings, in which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
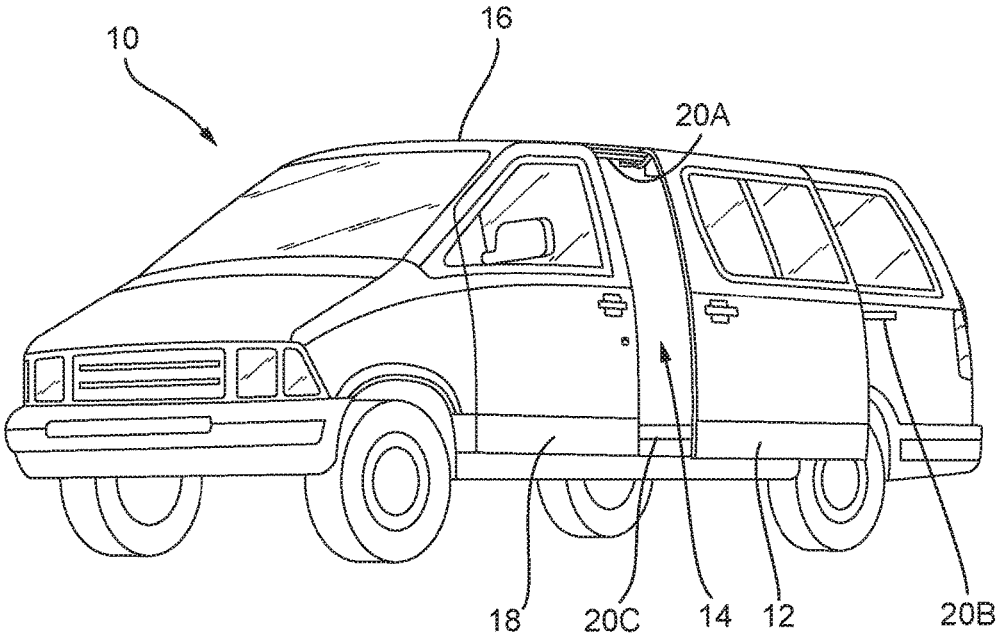
FIG. 1 is a pictorial representation of a motor vehicle comprising a sliding door shown in a partially open configuration.

With reference to FIG. 1, the present disclosure relates to a motor vehicle 10 comprising a sliding door 12. As depicted, the sliding door 12 may be provided at a side of the motor vehicle 10, although it may be provided at other positions, such as the rear of the motor vehicle. The sliding door 12 may selectively cover an aperture 14 in a body structure 16 of the motor vehicle 10. The sliding door 12 may be provided in addition to other doors of the vehicle, such as a pivotably openable front door 18.

The motor vehicle 10 may comprise one or more guide tracks 20A, 20B, 20C, which may guide the door 12 during opening and closing of the door. A first guide track 20A may be provided at or towards the top of the door 12. A second guide track 20B may be provided at an intermediate point between the top and bottom of the sliding door 12. A third guide track 20C may be provided at or towards the bottom of the sliding door 12. Although three guide tracks are shown, it will be appreciated that any number of guide tracks may be provided and they may be provided at other locations than those shown in FIG. 1.

Figure 2:
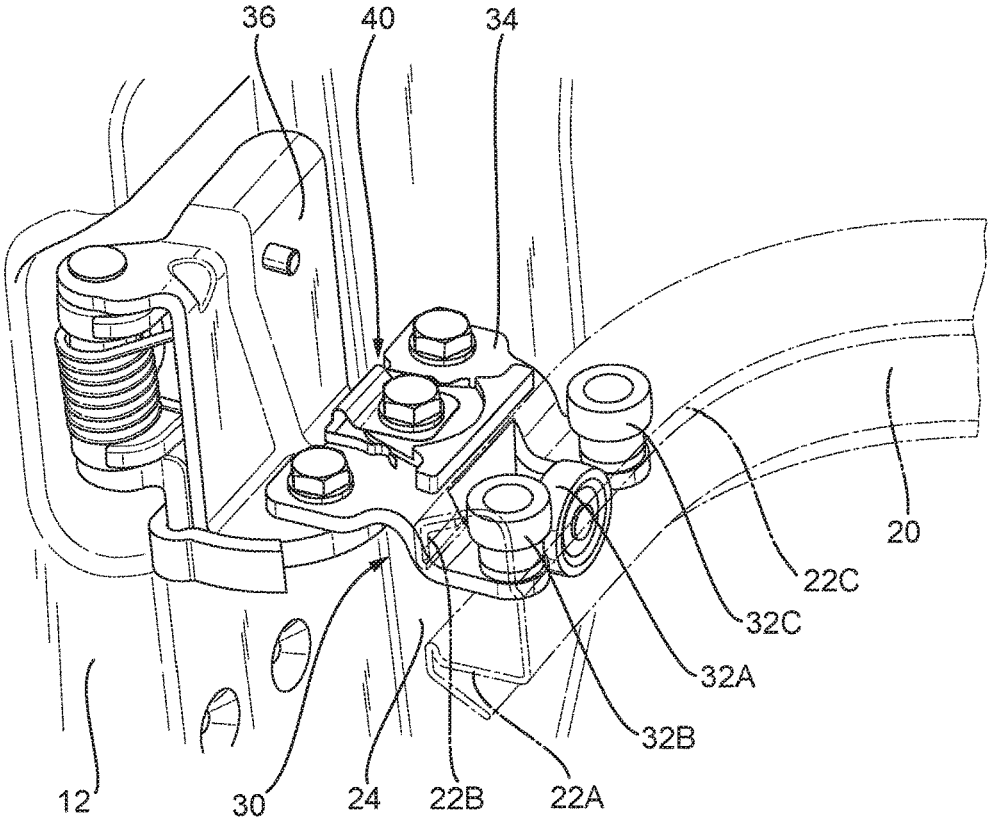
FIG. 2 is a perspective view of a vehicle sliding door brake assembly according to an arrangement of the present disclosure attached to a sliding door mechanism of a vehicle.

Referring now to FIG. 2, an example of such a guide track 20 is depicted. A sliding door mechanism 30, which is connected to the door 12, engages the track 20 so as to permit the door 12 to slide relative to the track 20. It will be appreciated that the sliding door mechanism 30 and guide track 20 cooperate to guide the door 12 not only forwardly and rearwardly, but also to move the door outwardly from the door aperture 14 when opening commences and inwardly at the end of a closing operation. Accordingly, the guide track 20 may be curved at one end, as depicted in FIG. 2.

The guide track 20 may be in the form of a channel that receives one or more wheels or rollers 32A, 32B, 32C, which may form part of the sliding door mechanism 30. The sliding door mechanism 30 may comprise a carrier 34 to which the wheels or rollers may be rotatably coupled. A first wheel 32A may rotate about a substantially horizontal axis and may travel along a bottom wall 22A of the track 20. Second and third wheels 32B, 32C may rotate about substantially vertical axes and may engage side walls 22B, 22C of the track 20. The carrier 34 may be coupled to the door 12 via an intermediate member 36, which may in turn be rotatably connected to the door 12.

Figure 3:
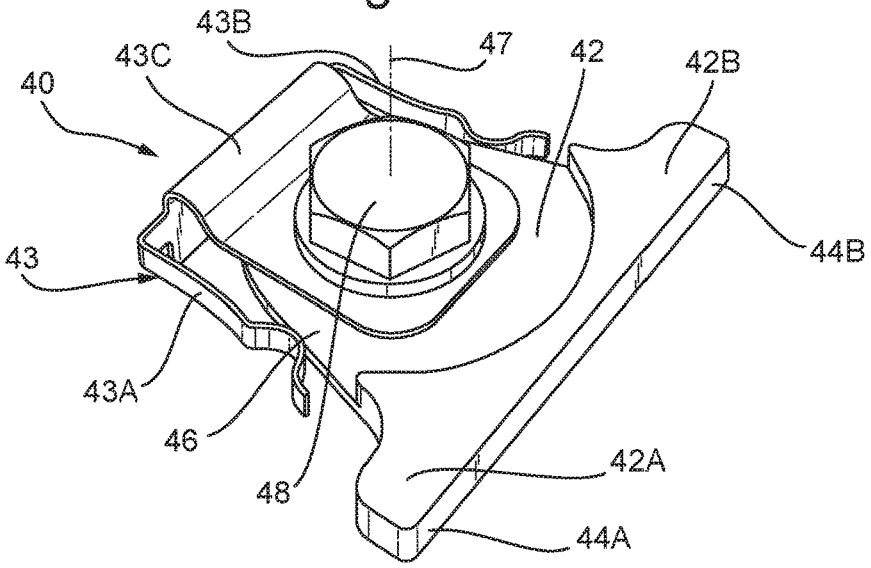
FIG. 3 is a perspective view of the vehicle sliding door brake assembly according to the arrangement of the present disclosure.

With reference to FIGS. 2 and 3, there is provided a brake assembly 40, which is configured to selectively apply a braking force resisting movement of the door 12. In particular, the brake assembly 40 comprises a brake member 42, which may move from a neutral position in which the brake member does not contact the track 20, to an engaged position, in which the brake member contacts the track 20. As shown in FIG. 2, the brake member 42 may be pivotably coupled to the carrier 34 and as such may rotate between the neutral and engaged positions. The brake assembly 40 further comprises a resilient element 43, which acts on the brake member 42 and serves to bias the brake member towards the neutral position.

The brake member 42 may rotate about a substantially vertical axis at a pivot point 47. The brake member 42 may be substantially planar, e.g. flat, and the brake member may lie in a substantially horizontal plane.

The brake member 42 may comprise first and second brake portions 42A, 42B. The first and second brake portions 42A, 42B may be disposed either side of the pivot point 47 (e.g. either side of a line perpendicular to the track and passing through the pivot point). Each of the first and second brake portions 42A, 42B may comprise brake surfaces 44A, 44B that may selectively engage the track 20. As shown in FIGS. 2 and 3, the brake surfaces 44A, 44B may be continuous. Accordingly, the first and second brake portions 42A, 42B may be adjacent to one another. In the particular arrangement shown, the braking surfaces 44A, 44B form a continuous braking surface that is parallel to a surface of the track when the brake member is in the neutral position. In alternative arrangements, the brake surfaces may be curved. The brake surfaces 44A, 44B may be provided with a material that increases friction between the brake member 42 and the track 20, for example the brake surfaces may be over molded with rubber or other such equivalent material.

The first and second brake portions 42A, 42B may be connected to a central portion 46 of the brake member 42. The central portion 46 may comprise the pivot point 47 about which the brake member 42 rotates. The brake member 42 may be held in place by virtue of a fixing bolt 48 that secures the brake member 42 to the carrier 34. The fixing may be arranged so that the brake member is free to rotate relative to the carrier 34.

The brake portions 42A, 42B may be spaced apart from the pivot point 47 and extend from the central portion 46 at a point between the pivot point 47 and the track 20. Furthermore, both brake portions 42A, 42B may remain disposed between the pivot point 47 and the track 20 regardless of which brake portion is in contact with the track 20. The central portion 46 and brake portions 44A, 44B may be unitary (e.g. integral) and as such may be formed from a single piece. The brake portions 44A, 44B may however be thicker than the central portion 46 so as to increase the mass of the brake portions for reasons which will be described below. Additionally or alternatively, additional weights may be provided at the brake portions 42A, 42B.

As depicted in FIG. 2 the carrier 34 extends through an opening 24 in the track 20. The opening 24 is provided between the bottom wall 22A and the second side wall 22B. The brake member 42 is configured so as to engage an outer surface of the second side wall 22B. Thus, when the brake member engages the track 20 the second side wall 22B may be held between the brake member 42 and one or more of the wheels 32B, 32C.

The resilient element 43 comprises first and second arms 43A and 43B. The first and second resilient arms 43A, 43B act on opposite sides of the central portion 46. The first and second resiliently biased arms 43A, 43B may be connected to one another by virtue of a central member 43C. The central member 43C may be coupled to the carrier 34 or as depicted in FIGS. 2 and 3 the central member 43C may extend over the pivot point 47 and may be held in place by the fixing bolt 48. The resiliently biased arms 43A, 43B and/or central portion 46 may be arranged such that a force is applied to the brake member 42 in a direction that does not pass through the pivot point 47 of the brake member 42. The sides of the central portion 46 may be configured such that when the brake member 42 rotates the resiliently biased arms 43A, 43B are displaced. The resiliently biased arms 43A, 43B may then apply a restoring force that urges the brake member to return to the neutral position. The resiliently biased arms 43A, 43B may be in the form of cantilevers which at one end are connected to the central member 43C and at the free end engage the central portion 46 of the brake member 42. In effect, the brake member 42 forms a cam and the resiliently biased arms form followers that move as the brake member 42 rotates, the followers being resiliently biased to return the cam to the neutral position.

Figure 4A:
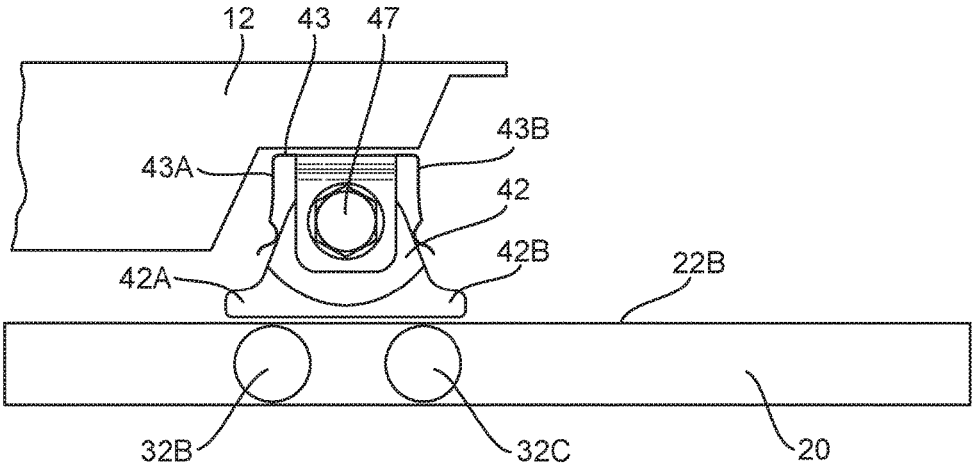
FIG. 4*a* is a schematic view and 4*b* are schematic views showing the brake member in a neutral position.
Figure 4B:
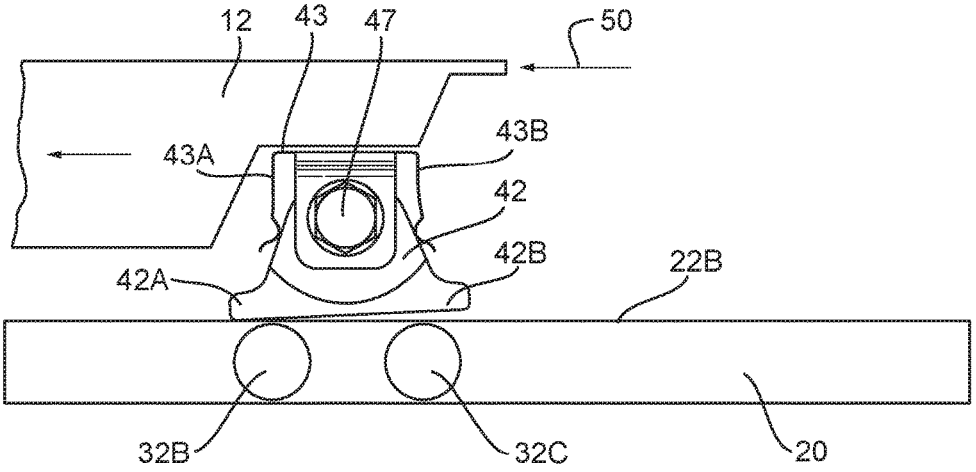
FIG. 4*b* is a schematic view of the brake member in a first engaged position when subject to an acceleration in a first direction.

Referring now to FIGS. 4 and 5, operation of the brake assembly 40 will now be described. FIG. 4*a* shows the brake member 42 in the neutral position in which neither the first brake portion 42A nor second brake portion 42B, are in contact with the track 20. A braking force is therefore not applied to the movement of the door 12. However, if an abusive force is applied to the door 12 in the closing direction (as depicted by arrow 50 in FIG. 4*b*), the door 12 may accelerate rapidly. As the brake portions 42A, 42B are offset from the pivot point 47 of the brake member 42, the inertia of the brake portions results in the brake member 42 rotating about the pivot point 47. As shown in FIG. 4*b*, the first brake portion 42A of the brake member 42 is then brought into contact with the side wall 22B of the track 20. The brake member 42 then applies a braking force to the closing of the door and thereby serves to limit the resulting force experienced by the door 12. When the closing force 50 is reduced or the door 12 otherwise stops moving, the resilient element 43, in particular the second resiliently biased arm 43B, may act on the brake member 42 so as to return the brake member to the neutral position.

The mass of the brake portions 42A, 42B (e.g. their thickness), the distance of the brake portions from the pivot point 47 and/or the restoring force of the resilient element 43 may be selected such that the brake portions engage the track 20 when the door 12 is subjected to an acceleration exceeding a particular threshold. For example, the particular threshold may be an acceleration that is below a level which may cause damage to the door or surrounding frame of the vehicle.

Figure 5A:
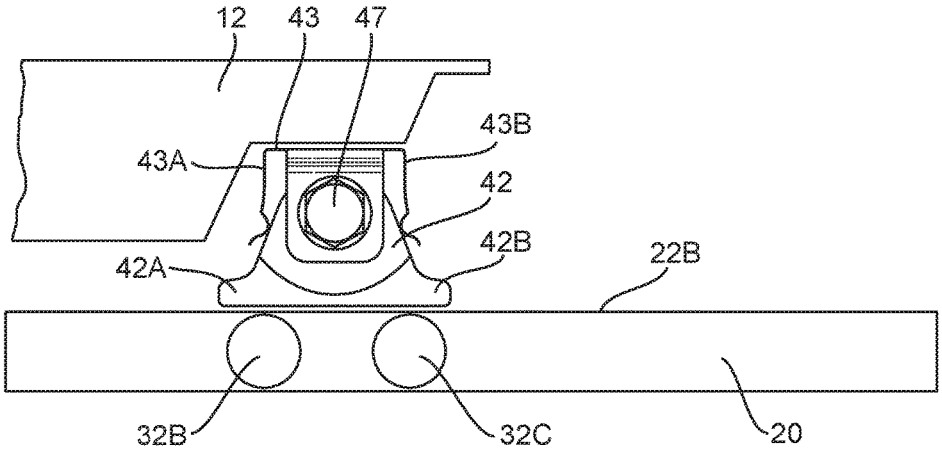
FIG. 5*a* is a schematic view of the brake member in a neutral position.
Figure 5B:
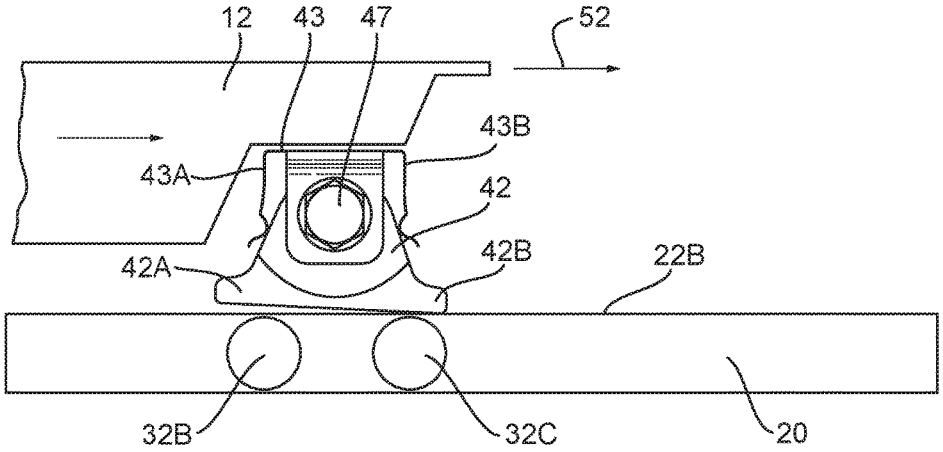
FIG. 5*b* is a schematic view of the brake member in a second engaged position when subject to an acceleration in a second direction.

Referring now to FIG. 5, the effect of an abusive load in the opposite direction is depicted. FIG. 5*a* shows the brake member 42 in the neutral position. However, if an abusive force is applied in the opening direction of the door 12 (as depicted by arrow 52 in FIG. 5*b*), the door 12 accelerates rapidly in the opening direction. The inertia of the first and second brake portions 42A, 42B results in the brake member rotating about the pivot point 47. The second brake portion 42B comes into contact with the side wall 22B of the track 20 and thus serves to reduce the acceleration experienced by the door 12. The brake member 42 may return to the neutral position when the force 52 has reduced or the door is fully open. The resilient element 43 may return the brake member 42 to the neutral position, in particular by virtue of the resiliently biased arm 43A which acts on the brake member.

In either of the scenarios depicted in FIGS. 4 and 5, as soon as contact is made between the brake surfaces 44*a*, 44*b* and the track surface, friction between the brake surfaces and the track may further pull the brake member towards the track surface, thereby increasing the braking force.

As described with reference to FIG. 4, the weight of the brake portions 42*a*, 42*b*, the distance of the brake portions from the pivot point 47 and/or the restoring force applied by the resilient element 43 may be configured such that the brake member 42 engages the track 20 when the acceleration in the opening direction exceeds a particular threshold. The opening and closing thresholds may be the same, or they may be different. Different opening and closing thresholds may be achieved by the resilient element 43 applying different restoring forces depending on which direction the brake member rotates. For example, the resilient element 43 may apply a larger restoring force if the brake member 42 moves in a clockwise direction (as depicted in FIG. 5*b*), which may increase the acceleration threshold at which the brake member 42 engages the track 20 when the door is being accelerated in the open direction.

It will be appreciated by those skilled in the art that although the invention has been described by way of example, with reference to one or more examples, it is not limited to the disclosed examples and alternative examples may be constructed without departing from the scope of the invention as defined by the appended claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle sliding door brake assembly, comprising:

a brake member connectable to a sliding door mechanism and configured to rotate about a pivot point, the brake member comprising first and second brake portions being positioned on opposite sides of the pivot point, forming an inertial counterweight to cause the brake portions to selectively engage the track, and together defining a continuous flat braking surface extending parallel to the track in a neutral position.

2. The vehicle sliding door brake assembly of claim 1, further comprising a resilient element arranged around the pivot point and configured to bias the brake member to a neutral position in which the brake portions are not engaged with the track.

3. The vehicle sliding door brake assembly of claim 2, wherein the resilient element includes at least one resiliently biased arm biased against the brake member.

4. The vehicle sliding door brake assembly of claim 2, wherein the brake member is symmetrical about an axis perpendicular to the track.

5. The vehicle sliding door brake assembly of claim 4, wherein the first and second brake portions are arranged one on each side of the axis perpendicular to the track.

6. The vehicle sliding door brake assembly of claim 5, wherein the first brake portion engages the track when a sliding door of the vehicle is subjected to an acceleration exceeding a first threshold in a first direction and the second brake portion engages the track when the sliding door of the vehicle is subjected to an acceleration exceeding a second threshold in a second direction opposite the first direction.

7. The vehicle sliding door brake assembly of claim 5, wherein the first and second brake portions are substantially parallel to the track when the brake member is in the neutral position.

8. The vehicle sliding door brake assembly of claim 1, wherein the brake member rotates about a substantially vertical axis at the pivot point.

9. The vehicle sliding door brake assembly of claim 1, wherein the sliding door mechanism comprises one or more wheels configured to engage the track, and wherein at least a portion of the track is arranged between the brake member and one or more of the wheels.

10. A vehicle sliding door brake assembly, comprising:

a brake member having first and second brake portions forming an inertial counterweight, the brake portions being positioned on opposite sides of a pivot point of the brake member and together defining a continuous flat braking surface parallel to a track of a sliding door mechanism, wherein the inertial counterweight causes the brake portions to rotate about the pivot point and to move from a neutral position in which the braking surface is not engaged with the track to an engaged position with the track when a sliding door of the vehicle is subject to an acceleration exceeding a threshold.

11. The vehicle sliding door brake assembly of claim 10, wherein the inertial counterweight, in the engaged position, causes the brake portions to selectively engage a track of the vehicle to provide a braking force.

12. The vehicle sliding door brake assembly of claim 11, further comprising a resilient element arranged around the pivot point and configured to bias the brake member to the neutral position in which the brake portions are not engaged with the track.

13. The vehicle sliding door brake assembly of claim 12, wherein the resilient element includes at least one resiliently biased arm that is biased against the brake member.

14. The vehicle sliding door brake assembly of claim 10, wherein the brake member is symmetrical about an axis perpendicular to the track.

15. The vehicle sliding door brake assembly of claim 14, wherein the first and second brake portions are arranged one on each side of the axis perpendicular to the track.

16. The vehicle sliding door brake assembly of claim 15, wherein the first brake portion engages the track when the sliding door of the vehicle is subjected to an acceleration exceeding a first threshold in a first direction and the second brake portion engages the track when the sliding door of the vehicle is subjected to an acceleration exceeding a second threshold in a second direction opposite the first direction.

17. The vehicle sliding door brake assembly of claim 16, wherein the first and second brake portions are substantially parallel to the track when the brake member is in the neutral position.

18. A vehicle sliding door brake assembly configured for attachment to a sliding door mechanism of a vehicle, comprising:

a brake member connectable to the sliding door mechanism and configured to rotate about a pivot point, the brake member comprising first and second brake portions forming an inertial counterweight that causes the brake portions to selectively engage a track of the vehicle so as to provide a braking force, wherein the first and second brake portions are positioned on opposite sides of the pivot point and together form a continuous flat braking surface that is parallel to the track when the brake member is in a neutral position, wherein the brake portions are configured to move from the neutral position in which the braking surface does not engage with the track to an engaged position in which at least a portion of the braking surface engages with the track when a sliding door of the vehicle is subjected to an acceleration exceeding a threshold.

19. The vehicle sliding door brake assembly of claim 18, further comprising a resilient element arranged around the pivot point and configured to bias the brake member to a neutral position in which the brake portion is not engaged with the track.

20. The vehicle sliding door brake assembly of claim 19, wherein the resilient element includes at least one resiliently biased arm biased against the brake member.

* * * * *